US006672479B2

(12) United States Patent
Shiraishi et al.

(10) Patent No.: US 6,672,479 B2
(45) Date of Patent: Jan. 6, 2004

(54) CLOSING STRUCTURE OF A DISPENSING CONTAINER

(75) Inventors: Yasuyuki Shiraishi, Urayasu (JP); Keiji Hamamoto, Osaka-fu (JP); Hirokazu Mihashi, Kameoka (JP)

(73) Assignees: Taisai Kako Co., Ltd./Nihon Tenganyaku (JP); Kenkyusyo Co., Ltd. (JP)

( * ) Notice: Subject to any disclaimer, the term of this patent is extended or adjusted under 35 U.S.C. 154(b) by 24 days.

(21) Appl. No.: 10/066,997

(22) Filed: Feb. 4, 2002

(65) Prior Publication Data

US 2002/0130139 A1 Sep. 19, 2002

(30) Foreign Application Priority Data

Mar. 13, 2001 (JP) ..... 2001-070060

(51) Int. Cl.[7] ..... B65D 35/56

(52) U.S. Cl. ..... 222/105; 222/189.06; 222/189.09; 222/212; 222/215; 222/494; 222/490

(58) Field of Search ..... 222/105, 95, 107, 222/212, 206, 213, 214, 215, 189.06, 189.09, 190, 490, 494, 481.5, 521, 545, 546, 554

(56) References Cited

U.S. PATENT DOCUMENTS

| | | | | |
|---|---|---|---|---|
| 3,221,945 A | * | 12/1965 | Davis, Jr. | 222/633 |
| 3,337,900 A | * | 8/1967 | Schwartzman | 401/206 |
| 4,463,880 A | | 8/1984 | Kramer et al. | |
| 4,646,945 A | * | 3/1987 | Steiner et al. | 222/207 |
| 4,760,937 A | * | 8/1988 | Evezich | 222/95 |
| 5,056,689 A | * | 10/1991 | Heyl et al. | 222/189.06 |
| 5,082,150 A | * | 1/1992 | Steiner et al. | 222/189.09 |
| 5,105,993 A | | 4/1992 | LaHaye et al. | |
| 5,154,325 A | * | 10/1992 | Ryder et al. | 222/189.06 |
| 5,213,236 A | | 5/1993 | Brown et al. | |
| 5,332,121 A | * | 7/1994 | Schmidt et al. | 222/95 |
| 5,431,310 A | * | 7/1995 | Kanner et al. | 222/212 |
| 5,454,486 A | * | 10/1995 | Mack et al. | 222/95 |
| 5,615,803 A | * | 4/1997 | Hatakeyama et al. | 222/94 |
| 5,632,420 A | * | 5/1997 | Lohrman et al. | 222/212 |
| 5,897,033 A | * | 4/1999 | Okawa et al. | 222/212 |
| 5,944,234 A | * | 8/1999 | Lampe et al. | 222/490 |
| 6,336,571 B1 | * | 1/2002 | Chibret et al. | 222/189.09 |
| 6,543,652 B1 | * | 4/2003 | Kelder et al. | 222/212 |

FOREIGN PATENT DOCUMENTS

| | | |
|---|---|---|
| EP | 0439999 A1 | 8/1991 |
| EP | 0606783 A1 | 7/1994 |
| JP | 09175566 | 7/1997 |
| JP | 11165755 | 6/1999 |

* cited by examiner

*Primary Examiner*—Gene Mancene
*Assistant Examiner*—Frederick Nicolas
(74) *Attorney, Agent, or Firm*—Wood, Phillips, Katz, Clark & Mortimer

(57) ABSTRACT

A closing member 3 is equipped with a dispensing valve 8 and a filter 7. The valve 8 is deformed resiliently to shift its valve head 82 downstream with its orifice 82*a* remaining closed if pressure less than a first predetermined pressure and more than a second predetermined pressure is acted on the inner surface of the valve head 82. The valve 8 returns to its original shape to shift the valve head 82 upstream with its orifice 82*a* remaining closed if the pressure is removed, thereby sucking fluid remaining within the passage 10 back to the upstream side of the filter 7. The closing member 3 has a supporter 31*d* that prevents the orifice 82*a* of the valve head 82 from opening when a negative pressure is generated in the bottle.

10 Claims, 10 Drawing Sheets

CLOSING STRUCTURE OF A DISPENSING CONTAINER

BACKGROUND OF THE INVENTION

1. Field of the Invention

The present invention relates to a closing structure of a fluid-dispensing container suitable for an aseptic eyedropper, cosmetic liquid container without antibiotic, or the like. Herein, "fluid" means material capable of flowing, such as fluid or fluidized material, including liquid, paste, powder, and the like.

2. Description of Related Art

Closing structure of a fluid-dispensing container including a dispensing valve secured in the mouth of one of various types of containers, which remains closed if the pressure in the container is atmospheric and opens if the pressure exceeds a predetermined pressure, is disclosed in each of Japanese Laid-open Patent Application No. Hei. 8-282704, Japanese Laid-open Patent Application No. Hei. 8-282703, U.S. Pat. Nos. 5,213,236, 5,339,995, and 5,439,143.

The above-mentioned closing structure is preferably usable in dispensers of eyedrops, i.e. ophthalmic liquid medicament, liquid detergents and liquid foods. A container having such closing structure surely prevents leakage of contained liquid and discharges the liquid smoothly as needed.

With the above-described prior art closing structure, a negative pressure is generated within the container after ceasing the discharge of the contained liquid. The negative pressure makes the dispensing valve to open inward, thus introducing ambient air into the container until the negative pressure disappears. As the ambient air includes pathogenic microbes such as true fungi, bacteria, protozoa and viruses, the microbes are mixed in the liquid in the container. Therefore, to subdue such microbes, several kinds of preservatives, antibiotics, antibacterial agents, antiseptics or antimicrobials, hereinafter named generically as "preservatives", to meet purposes of the contained liquid are added to the liquid.

However, various problems resulting from side effects of the preservatives have been pointed out recently. For example, repetitive use of eyedrops containing preservatives might cause inflammation or damage of eyes. Especially for those wearing contact lenses, use of eyedrops containing preservatives even in low density might cause allergic reaction. Some preservatives contained in shampoo are pointed out to have possibility of causing inflammation of scalp or falling off of hair. Furthermore, consumers of recent years tend to dislike and avoid contained preservatives themselves.

Japanese Laid-open Patent Application No. Hei. 4-297264 and Japanese Laid-open Patent Application No. Hei. 6-14972, for example, disclose eyedrops containers with filters secured in a discharging passage for eliminating only additives such as preservatives that make no contribution to the medicinal virtues when liquid contained in the bottle is discharged dropwise through the discharging passage. However, such prior art containers cannot fully lower the density of preservatives if the eyedrops contain enough amount of preservatives to achieve sufficient sterilization effect. More specifically, because microbes in the ambient air are allowed to come to be mixed in the liquid within the above-described eyedrops container and the microbes mixed in the liquid are sterilized with the preservatives, it is impossible to fully lower the density of preservatives in the liquid, therefore, some amount of preservatives remains in the eyedrops to be discharged dropwise.

Japanese Laid-open Utility Model Application No. Sho. 63-184037 discloses an eyedrops container, whose body has a tubular shape whose end portion is of compressed shape or whose body is foldable so that it can be transformed into compressed shape, enabling volume within the container body to decrease with decrease of liquid contained therein. The container has a hydrophilic filter secured in the discharging passage to discharge liquid dropwise. The filter allows the ophthalmic liquid medicament to pass through and does not allow air and bacteria to pass through. Such prior art eyedrops container can lower density of the preservatives in the liquid as low as possible because it prevents microbes from mixing into the contained liquid by completely preventing ambient air from entering the container. However, the eyedrops container cannot have transparency because the body of the container cannot be made of plastic material but should be made of aluminum tube and the like, as plastic deformation of the container body of monolayer structure is required. Therefore, remaining amount of the eyedrops cannot be seen from outside. Furthermore, it cannot be kept upright since the container body is deformed compressedly as the contained liquid is consumed, thus spoiling convenience in use.

Each of Japanese Laid-open Patent Application No. Hei. 9-175566 and Japanese Laid-open Patent Application No. Hei. 10-165222 discloses a dispensing container comprising a delaminatable laminated bottle and a closing member such as a cap or a plug mounted to and closing the mouth of the bottle. The laminated bottle consists of an outer layer and an inner layer laminated onto and delaminatable from the inner surface of the outer layer. The outer layer forms an outer bottle, whereas the inner layer forms a bag for containing fluid. The outer layer has a vent to introduce ambient air into the space between the inner and outer layers. The closing member has therein a discharging passage through which liquid is discharged out of the inner layer. A check valve is secured in the discharging passage. This type of dispensing container introduces ambient air into the space between the outer and inner layers as the liquid contained in the bag decreases, deflating the bag, and prevents flowback of the liquid and entrance of ambient air into the bag by means of the check valve. Therefore, the liquid in the bag is protected from contamination by microbes, obviating the need of adding preservatives into the liquid, for the liquid is discharged without entrance of ambient air into the bag. However, liquid remaining in the discharge opening on the downstream side of the check valve may be contaminated by microbes such as true fungi, bacteria and viruses as the liquid is exposed to the ambient air, thus incurring possibility of dispensing contaminated liquid.

The invention aims to provide a closing structure of a dispensing container which has a valve which is closed if pressure acted on the inner surface of the container is atmospheric and opens if the pressure acted on the inner surface exceeds a predetermined pressure and which clears away the difficulties of the prior art structure.

SUMMARY OF THE INVENTION

A closing structure of a dispensing container according to the first aspect of the present invention provides a closing member mounted on the mouth of a bottle including a body and a mouth, the closing member having a discharging passage through which fluid is discharged out of the bottle; a dispensing valve is located in the passage in order to open and close the passage; and a filter is located in the passage on the downstream side of the valve. The downstream end portion of the passage may be defined on the downstream side of the filter. The valve may include a valve flange, a valve head and a connector sleeve of a resilient flexible structure. The valve flange seals a periphery of the passage. The valve head may have an orifice that opens to allow flow of fluid therethrough if a first predetermined pressure acts on the inner surface of the valve head and closes to stop the flow of fluid if the first pressure removes from the inner surface. The connector sleeve may be connected to an inner periphery of the valve flange at one end and to an outer periphery of the valve head at the other end. The connector sleeve may be deformed to shift the valve head downstream if a second predetermined pressure which is less than the first pressure acts on the inner surface of the valve head, further the sleeve may return to its original shape if the second pressure removes from the inner surface to suck fluid remaining within the downstream end portion of the passage back to the upstream side of the filter.

The dispensing container may be formed as a bottle with monolayer structure. Otherwise, the container may also include an outer bottle including a body and a mouth and an inner bag for containing fluid housed within the outer bottle, the inner bag deflating or collapsing with the decrease of fluid contained in the bag.

Even if internal pressure of the container should rise in smaller amount than a predetermined amount, the rise of the internal pressure is modified and the orifice of the dispensing valve is kept closed, because the valve head is shifted downstream owing to the closing structure according to the first aspect described above, preventing undesired outflow of fluid in storing or handling. The contamination of fluid from external cause is prevented because fluid remaining in the downstream end portion of the passage, which is on the downstream side of the filter, is sucked back to the upstream side of the filter through the restoring force of the valve. The filter should preferably be one that is able to prevent predetermined kinds of microbes such as bacteria and true fungi from passing through from the downstream side (i.e., outside of the container) to the upstream side (i.e., inside of the container). For example, a membrane filter is preferred.

A closing structure according to the second aspect of the present invention is suitable for a dispensing container having an outer bottle including a body and a mouth and an inner bag for containing fluid housed within the outer bottle and having a discharge opening communicating to the mouth of the outer bottle, the outer bottle having a vent to introduce ambient air into space between the outer bottle and the bag. The closing structure provides a closing member having a discharging passage through which fluid is discharged out of the bag and mounted on the mouth of the outer bottle and a dispensing valve located in the passage in order to open and close the passage. The valve may include a valve flange and a valve head. More specifically, a valve flange and a valve head are connected via a connector sleeve of a resilient flexible structure to constitute the valve. The valve flange seals a periphery of the passage. The valve head has an orifice that opens to allow flow of fluid therethrough if a first predetermined pressure acts in the bag and closes to stop the flow of fluid if the first pressure removes. The closing member may have a supporter that makes contact with and supports the valve head to prevent the orifice from opening if a negative pressure is generated in the bag.

Owing to this aspect, the fluid in the container is effectively protected against the attack of microbes in the ambient air because of liquid-tightness and air-tightness when the orifice of the valve is closed, because the orifice is defined by the valve head itself. The valve head is made of elastic material such as rubber to be deformable so that it is able to open and close the orifice. The container is constituted by the outer bottle and the inner bag, which generates a negative pressure in the inner bag after dispensing fluid. The supporter prevents the valve head from opening the orifice through inward deformation by the negative pressure, thus preventing ambient air and the liquid that is once discharged through the valve from entering through the valve and into the bag, obviating the need of preservatives in the liquid in the bag.

Most preferably, the closing structure according to the invention provides all components included in the first and second aspects.

BRIEF DESCRIPTION OF THE DRAWINGS

FIG. 4(*b*) is a semi-sectional front view of the first member;

FIG. 4(*c*) is a bottom view of the first member;

FIG. 5(*b*) is a vertical section view of the valve;

FIG. 5(*c*) is a bottom view of the valve;

DETAILED DESCRIPTION OF THE INVENTION

Figure 1:
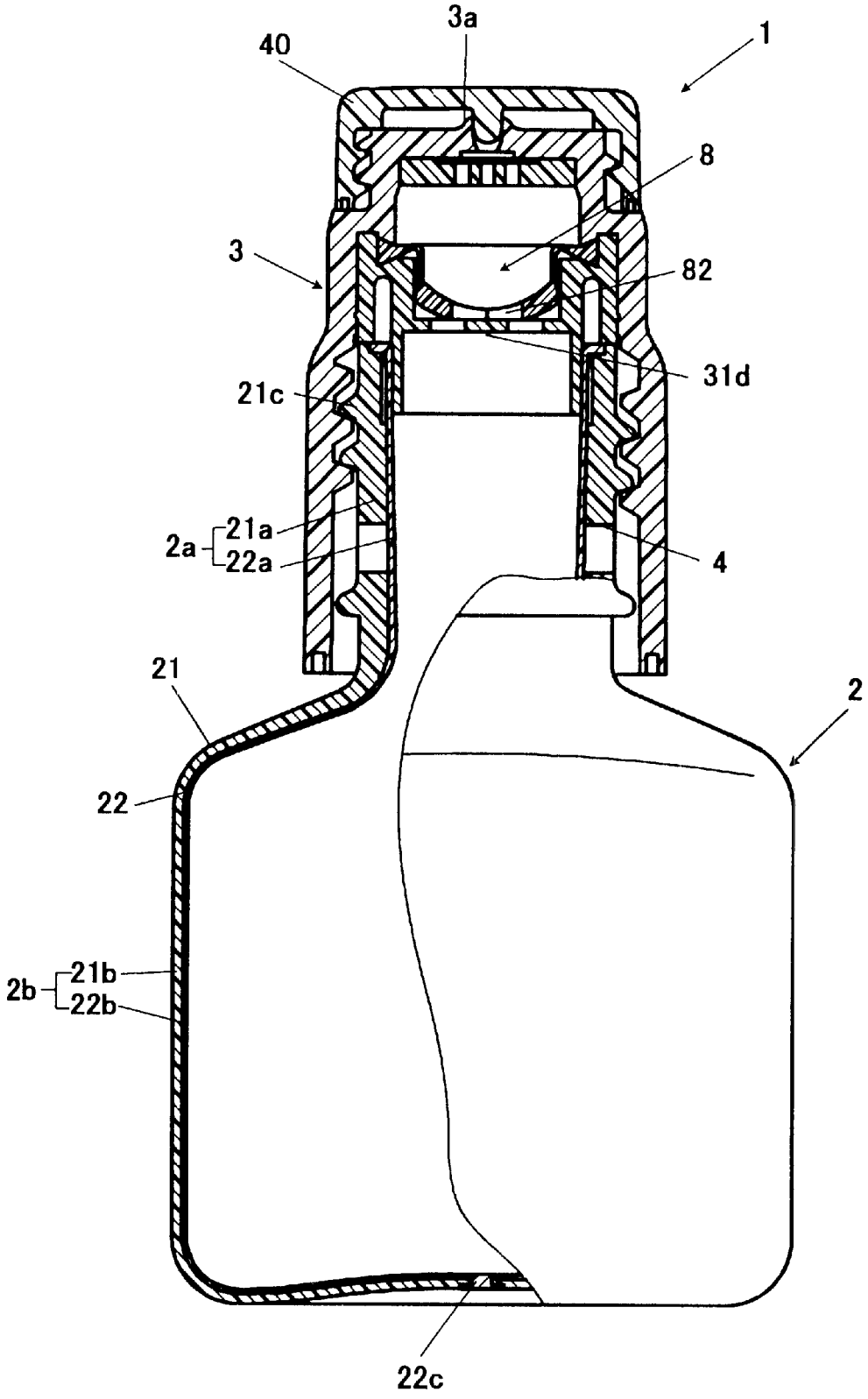
FIG. 1 is a partly sectional front view of a dispensing container provided in a first embodiment of the invention.

The closing structure according to this invention may be applied to a dispensing container having an outer bottle including a body and a mouth and an inner bag for containing fluid housed within the outer bottle and having a discharge opening communicating to the mouth of the outer bottle, the outer bottle having a vent to introduce ambient air into space between the outer bottle and the bag.

Fluid such as eyedrops and detergent is contained in the bag. With the decrease of contained fluid, ambient air flows into the space between the outer bottle and the inner bag through the vent to make the pressure around the bag atmospheric again, whereas the bag deflates or collapses. The inflow of the ambient air into the bag through the discharge opening is prevented by a dispensing valve that also functions as a check valve. Therefore, the container does not introduce the ambient air into the bag, obviating the need of adding preservatives into the fluid in the bag.

Though the dispensing container can be made up by molding the outer bottle and the inner bag separately and inserting the bag into the outer bottle, preferably the container is a delaminatable laminated bottle made up by laminating a inner layer forming the inner bag onto the inner surface of an outer layer forming the outer bottle so that the inner layer is capable of delaminating from the outer layer.

Preferably a check valve that allows ambient air to flow into the space between the outer bottle and bag and prevents the air in the space from flowing out of the space is secured in the vent. When the outer bottle having the check valve is squeezed and deformed, air in the space is compressed to increase the pressure of air in the space, so as to compress the bag and make the fluid in the bag discharged out of the discharge opening. In the case of using a container having a vent without such a check valve, it is sufficient that the user squeezes and deforms the outer bottle with covering the vent with a finger or the like.

In a preferred embodiment of the invention, the closing structure provides a closing member mounted on the mouth of the outer bottle and having a discharging passage, through which fluid is discharged out of the bag, a dispensing valve secured in the passage in order to open and close the passage, and a filter secured in the passage on the downstream side of the dispensing valve. A downstream end portion of the passage is defined on the downstream side of the filter.

The dispensing valve includes a valve flange that seals a periphery of the passage, a valve head having an orifice that opens to allow flow of fluid therethrough if pressure acted on the inner surface of the valve head is more than a first predetermined pressure and closes to stop the flow of fluid if the pressure acted on the inner surface is less than the first predetermined pressure, and a connector sleeve connected to an inner periphery of the valve flange at one end and to an outer periphery of the valve head at the other end.

The connector sleeve has a resilient flexible structure so that it is deformed to shift the valve head downstream if pressure acted on the inner surface of the valve head is more than a second predetermined pressure that is less than the first predetermined pressure and returns to its original shape if the pressure acted on the inner surface is less than the second predetermined pressure, thereby sucking fluid remaining within the downstream end portion of the passage back to the upstream side of the filter.

The closing member may have a supporter that makes contact with and supports the valve head to prevent the orifice from opening if a negative pressure is generated in the bag.

According to the closing structure, ambient air is prevented from flowing into the inner bag by the dispensing valve with the bag deflating in accordance with the decrease of contained fluid, thus preventing microbes in the ambient air from being mixed in the fluid. On the other hand, the outer bottle is kept substantially in its original shape and dimensions until the contained fluid is finished since the outer bottle squeezed and deformed by being pressed with hand or the like returns to its original shape through its resilience as ambient air flows into the space between the outer bottle and the inner bag. Therefore, the user can keep the dispensing container in upright position, which enhances the convenience in use. The space within the bag is kept aseptic or free from microbes without adding conservatives in the fluid, since ambient air does not flow into the bag as the bag deflates with the decrease of contained fluid. Plastic materials having sufficient transparency, sufficiently low gas permeability and sufficiently low water permeability can be used as material for molding the bag and the outer bottle, each plastic material providing the container with good properties suitable for intended use, for example, an eyedrops container or a detergent container.

The container keeps the contained fluid aseptic even after opening the cap with no preservative or little amount of preservative contained in the fluid, as the filter secured in the discharging passage prevents the microbes in the ambient air from permeating into the contained fluid. If a preservative for the fluid might be used, a filter to remove not only the microbes but also the preservative selectively may preferably be used.

Microbes are prevented from proliferating in fluid remaining in the proximity of the dispensing valve, in particular, on the downstream side of the valve, since the fluid on the side is also protected from the ambient air by the filter secured on the downstream side of the valve. A space large enough for the dispensing valve to move and to open and close the orifice therein is defined between the dispensing valve and the filter, with microbes being prevented from proliferating in the space.

Microbes are prevented from proliferating also in the downstream end portion of the passage, since fluid remaining in the portion is sucked back into the space between the filter and the dispensing valve and substantially no fluid remains in the space. Microbes are also prevented from proliferating in fluid sucked back into and remaining in the space between the valve and the filter, as the liquid is protected by the filter. The fluid remaining in the space between the valve and the filter can be discharged out of the container through the downstream end portion when pressure in the space is increased by the downstream shift of the valve head, before the orifice is opened and the fluid contained on the upstream side of the valve is dispensed. In discharging droplets into a sensitive organ, for example, in discharging eyedrops into an eye, the user can discharge droplets that are newly dispensed out of the inner bag after disposing away of a few droplets by positioning the container upside down.

In the present invention described above, it is preferred that the valve head is generally convex toward the inner side of the container and has a substantially flat face at the central part of the inner and upstream surface and that the supporter has a supporting surface capable of making a face contact with the substantially flat face. Owing to the structure, if pressure in the container is increased in relatively small amount, centripetal force owing to the pressure is converted to compressive force along the spherical surface in the inner surface of the valve head, closing the orifice more tightly. By providing the valve head with a substantially flat face at the central part of the inner and upstream surface and providing the supporter with a supporting surface that makes a face contact with the substantially flat face, the orifice is surely prevented from opening resulting from an inward deformation of the valve head, thus preventing the ambient air from flowing into the bag.

The dispensing containers according to the invention can be realized as cosmetic containers, detergent containers, medical containers such as eyedrops containers, and the like. Preferably the container consists essentially of a delaminatable laminated bottle having an outer bottle and an inner bag. A closing member such as a plug may be mounted on the mouth of the laminated bottle and an outer cap that covers the closing member and closes the discharging passage through the closing member may be provided detachably.

The delaminatable laminated bottle can be molded in a structure having a body and a mouth. It can be made by a suitable molding, such as an injection blow molding, a direct blow molding and an injection molding. The delaminatable laminated bottle can be made by molding an inner layer preform and an outer layer preform separately, inserting the inner layer preform into the outer layer preform to make a laminated parison, and blow molding the laminated parison. The bottle may be of laminar structure consisting of an inner layer forming an inner bag and an outer layer forming an outer bottle all over the body and the mouth. Alternatively, an inner bag made of film may be inserted into an outer bottle having a body and a mouth, with the inner bag and the outer bottle molded separately.

Preferably the outer bottle and the bag is formed relatively thick at the bottle finish, including the mouth of the bottle, so that the finish has sufficient rigidity. On the other hand, as to the body of the bottle, it is preferred that the outer bottle has squeezability and resiliency for returning to its original shape and that the bag is formed of film that easily deflates with the decrease of the liquid contained therein. It should be noted that the outer bottle and the bag may respectively be of monolayer structure or multilayer structure.

Polyolefin, such as polyethylene (PE) and polypropylene (PP), or any other suitable plastic material may be used as a molding material for the inner bag, whereas saturated polyester, such as polyethylene terephthalate (PET) and polyethylene naphthalate (PEN), or any other suitable plastic material may be used as a molding material for the outer bottle. For eyedrops container, material for the outer bottle and the inner bag may be selected to have high transparency and low water permeability. Preferably, material with high chemical resistance such as PE should be selected as a molding material of the bag because the bag has to be directly in contact with the medical liquid contained therein, whereas material with high transparency and low water permeability, for example, PET or soft glass, should be selected as a molding material of the outer bottle.

The vent may be formed at the finish, at the side of the body, or at the bottom, of the outer bottle. A check valve may be provided to close the vent. Structure of the check valve may be selected at discretion. In one embodiment of the invention, a valve body functioning as a plug is fitted in the vent of the outer body. In another embodiment, the inner bag itself functions as the check valve. That is, the vent is usually covered with and sealed by the bag from inside of the outer bottle and the sealing portion of the bag is deformed inwards by atmospheric pressure and opens the vent when a negative pressure is generated in the space between the outer bottle and the bag, thus a portion of the bag functioning as a check valve. Preferably the sealing portion of the bag has a resilience to return to its original shape. For example, the vent is formed at the finish of the outer bottle and the finish of the bag to cover the vent is made thicker than the body of the bag, the finish of the bag functioning as a sealing portion of the vent and the body of the bag deflating as the liquid contained therein decreases.

Without a check valve to close the vent, the liquid can be discharged dropwise through the discharging passage as the inner bag is compressed from outside owing to increased pressure in the space between the outer bottle and the inner bag by squeezing the body of the outer bottle if the vent is made smaller in diameter than the dispensing passage. If the body of the outer bottle is squeezed with small amount of liquid in the bag and with the vent consisting of a small hole of 0.1 mm to 0.5 mm in diameter, the decrease in the volume of the bottle is larger than the volume of air flowing out of the space through the vent. Consequently air pressure in the space between the outer bottle and the bag is increased. Therefore, the bag is compressed from outside and deflates so that liquid is discharged out of the bag through the discharging passage through the closing member. The effective cross section of the passage should be designed to be enough greater than that of the vent so that the flow resistance with the fluid flowing out through the passage is smaller than the flow resistance with air flowing in through the vent.

The closing member may consist of one piece or two or more assembled or combined pieces. The closing member may be a portion or a part of any member. The closing member may be inserted in the mouth of the bottle or covered outside or over the mouth. Preferably the closing member has a discharging nozzle, especially for dropwise discharging, with the discharging passage extending through the axial center of the nozzle.

The filter prevents microbes from passing from its downstream side to its upstream side. Any suitable filter such as a filter of sintered compact and a porous membrane can be used.

Preferably, the content of the passage on the downstream side of the filter should be designed not to be greater than the content of one droplet discharged from the passage. For example, the content of the passage should be not greater than 0.05 ml. By the design, liquid remaining on the downstream side of the filter is completely sucked back to the upstream side with the returning of the connector sleeve into its original shape.

A cap may be mounted over the mouth of the bottle. The cap may have a projection projecting into the passage on the downward side of the filter and filling the cavity, thus preventing liquid passing through the filter from adhering to the inner surface of the cap when the body of the bottle is squeezed with the mouth being capped.

The Best Mode of Carrying Out the Invention

Figure 2:
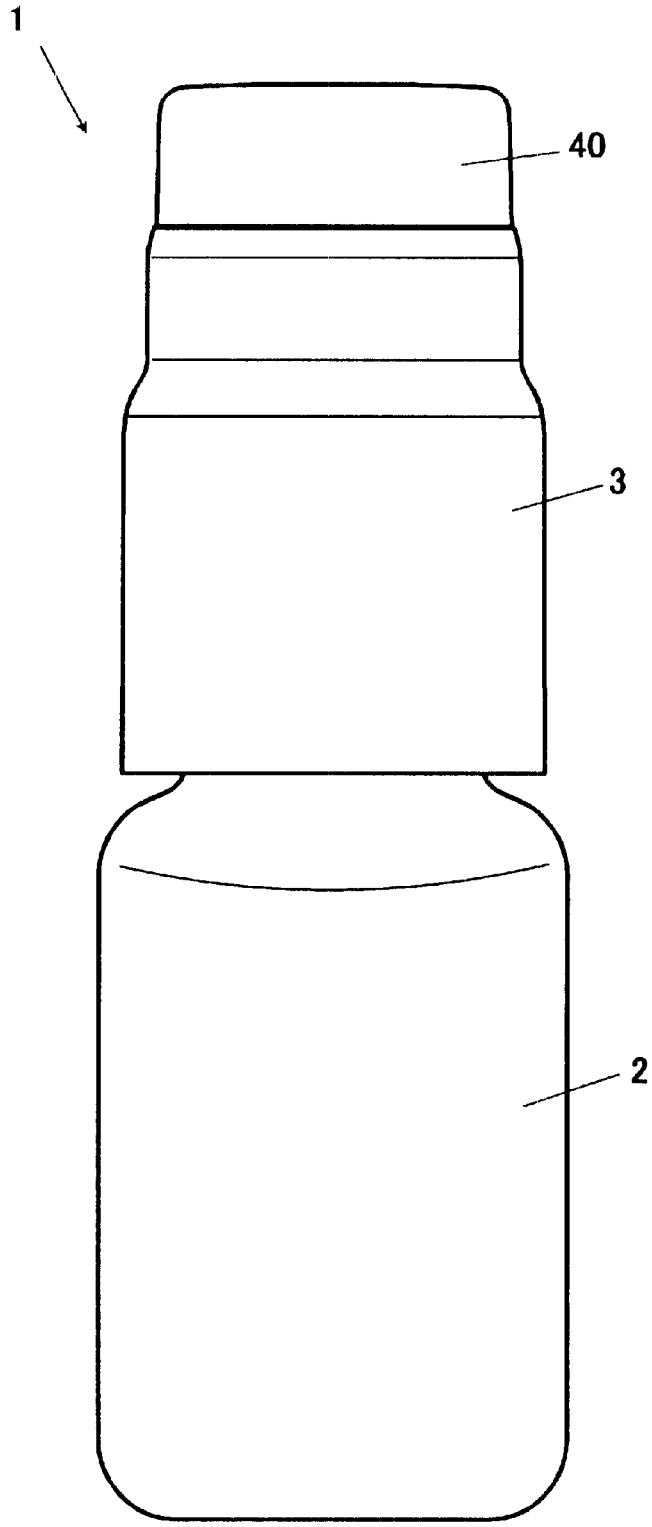
FIG. 2 is a side view of the container shown in FIG. 1.
Figure 3:
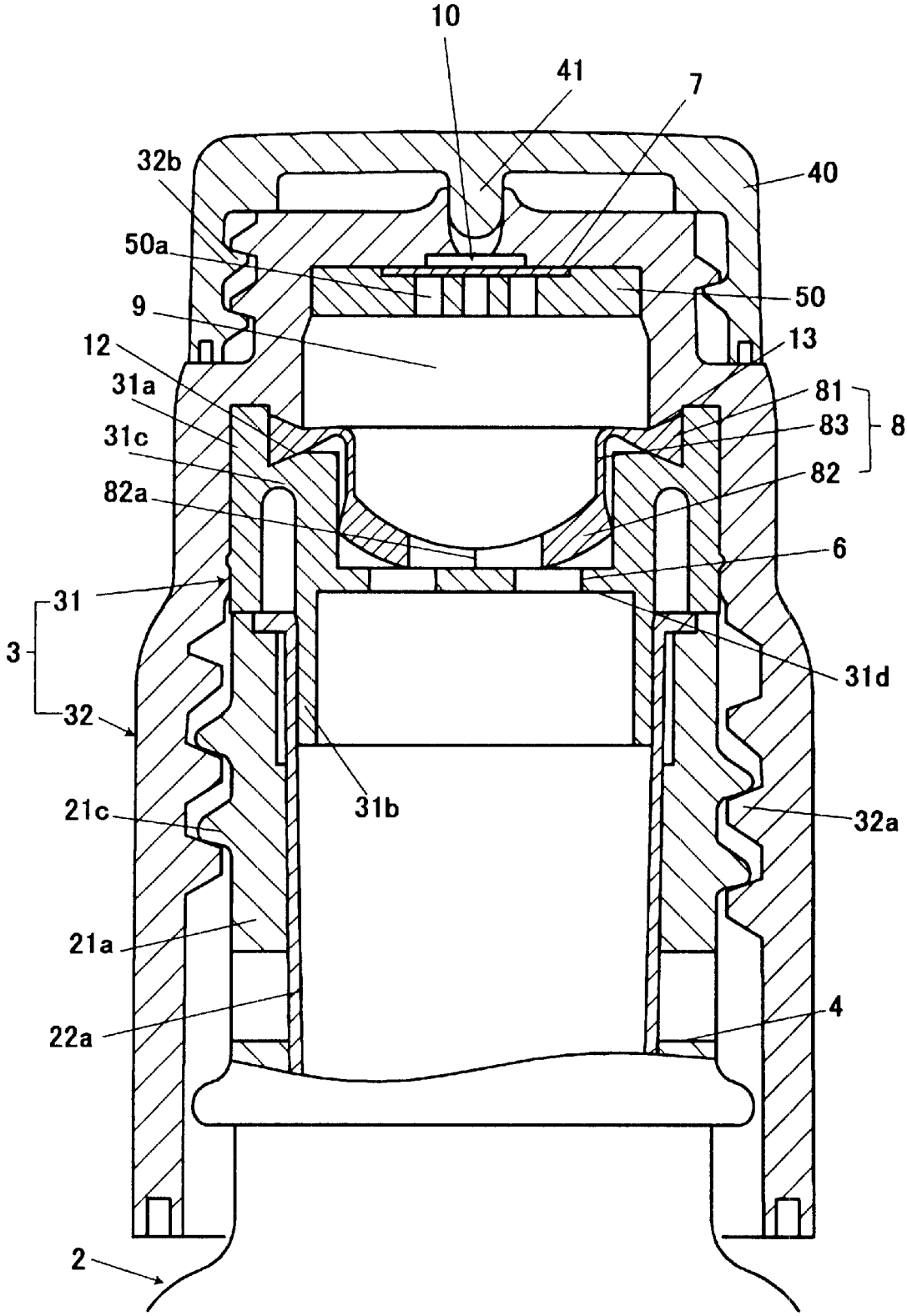
FIG. 3 is an enlarged vertical sectional view of a part of the container including the mouth shown in FIG. 1.
Figure 4:
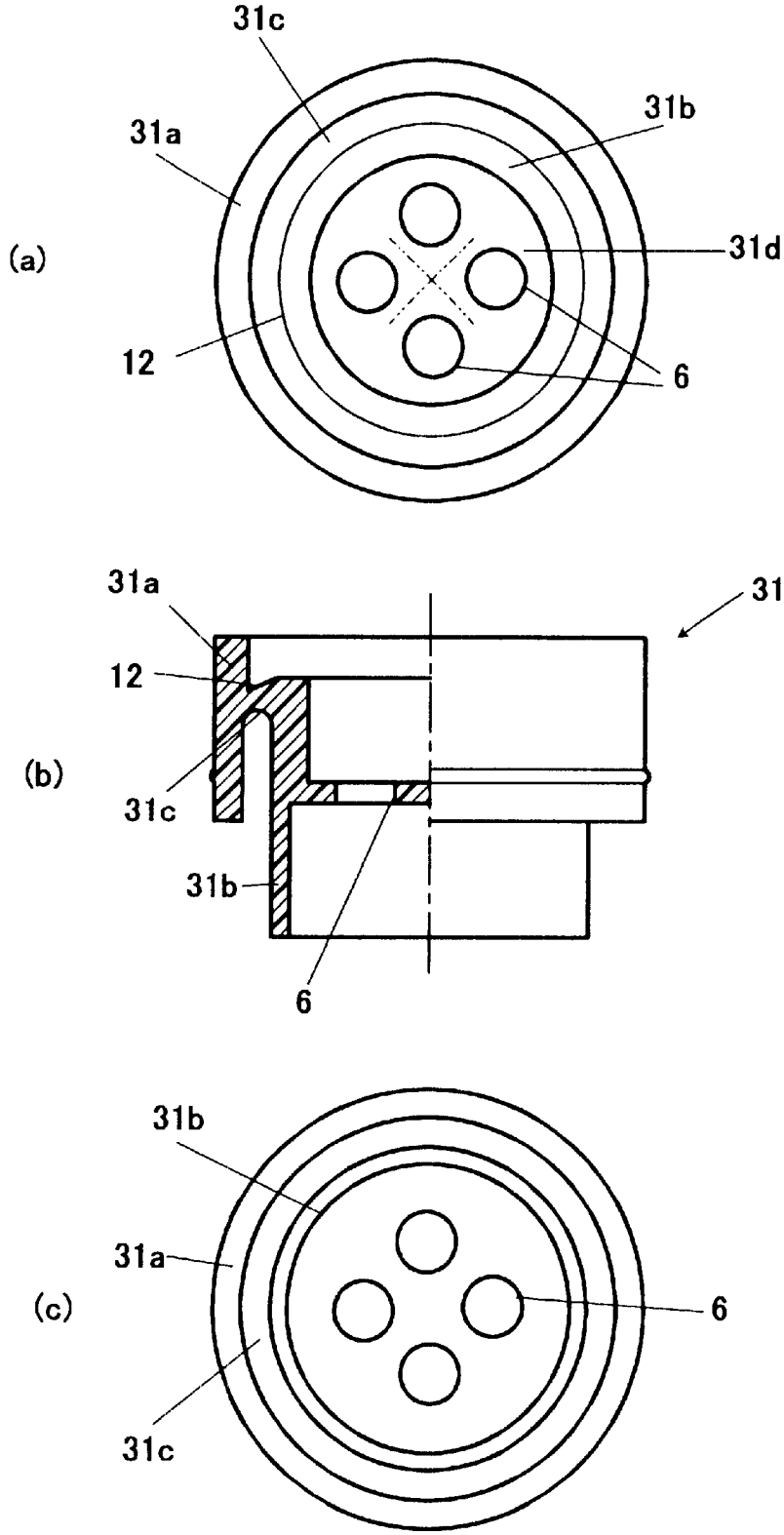
FIG. 4(*a*) is a plan view of a first member of a plug assembly, which is filled in the mouth of the container.

Now some preferred embodiments of the present invention will be described referring to the drawings. FIG. 1 to 3 disclose an eyedrops container as an embodiment of the dispensing containers according to the invention. The eyedrops container 1 consists mainly of delaminatable laminated bottle 2 which comprises a mouth or finish 2*a* and a body 2*b*. A cap 40 and a plug assembly (i.e., closing member) 3 which has a discharging nozzle 3*a* are mounted on the mouth or finish 2*a* so that liquid from the bottle can pass through a discharging passage 10 formed through the plug assembly 3 and can be discharged dropwise out of the tip of the discharging nozzle 3*a*.

The bottle 2 consists of a laminated structure of an outer bottle 21 (i.e., an outer layer) and a fluid-containing bag 22 (i.e., an inner layer). As the dispensing container of this embodiment consists mainly of a delaminatable laminated bottle, the outer bottle 21 is herein referred to as an "outer layer" and the bag 22 is herein referred to as an "inner layer", though the invention includes a variety of outer bottles and fluid-containing bags which are normally difficult to be referred to as "inner and outer layers".

The inner and outer layers 21, 22 respectively have cylindrical finishes 21*a*, 22*a* and bodies 21*b*, 22*b* with oval or oblong cross sections. In other words, a bottle finish 2*a* consists of an outer finish 21*a* and an inner finish 22*a,* whereas a bottle body 2*b* consists of an outer body 21*b* and an inner body 22*b*. The outer layer 21 should preferably be molded out of a hard synthetic resin such as PET or EVOH, whereas the inner layer 22 should preferably be molded out of such a synthetic resin that can be easily delaminated from the outer layer 21, for example, polyolefin resin such as polyethylene resin. The inner finish 22*a* defines a discharge opening of the fluid-containing bag.

The upper end of the inner finish 22*a* engages the upper end of the outer finish 21*a*. A plurality of knurled portions extending axially and located separately can be made on the inner surface of the outer finish 21*a,* thereby preventing relative circumferential movement between the outer and inner finishes 21*a,* 22*a*.

The outer finish 21*a* has at least one vent 4 for introducing ambient air into the space between the outer body 21*b* and inner body 22*b*. In this embodiment, two vents 4 are formed in diametrically opposite positions. Each vent 4 is formed through the outer layer 21 and not formed through the inner layer 22. A screw thread 21*c* is formed on the outer surface of the outer finish 21*a*.

The inner body 22*b* is made of thin plastic film and easily deflates or collapses with decrease of liquid contained therein. The inner finish 22*a* is formed thicker than the inner body 22*b* and has resilience to return to cylindrical shape.

The vents 4 formed through the outer finish 21*a* are usually covered with and sealed by the inner finish 22*a* from inside. Thus the inner finish 22*a* functions as a closing or sealing member of each vent 4 and as a check valve which opens each vent 4 when the inner finish 22*a* is deformed radially inwards by atmospheric pressure as a negative pressure has been generated in the space between the outer and inner bodies 21*b*, 22*b*.

At a central portion of a bottom of the inner layer 22, a flange 22*c* is formed unitarily so as to engage with a central portion of a bottom of the outer layer 21, thereby preventing axial movement of the bottom of the inner layer 22 toward the finish 2*a*.

The plug assembly 3 consists essentially of a first member 31 fitted in the bottle finish 2*a* and a second member 32 axially connected to the first member 31 and screwed over the outer periphery of the finish 2*a*.

The first member 31 is formed by combining unitarily a first cylindrical portion 31*a*, the base of which is in contact with the distal edge of the bottle finish 2*a*, and a second cylindrical portion 31*b*, which is disposed inside the first cylindrical portion 31*a*, via a flange 31*c*, which extends radially outward from the distal end of the second cylindrical portion 31*b*. As the inner diameter of the first cylindrical portion 31*a* is larger than the outer diameter of the second cylindrical portion 31*b,* there is a space between the inner surface of the first cylindrical portion 31*a* and the outer surface of the second cylindrical portion 31*b*. A proximal end of the second cylindrical portion 31*b* protrudes further to the proximal side, that is, toward the bottom in FIG. 1, than a proximal end of the first cylindrical portion 31*a*. The proximal end of the second cylindrical portion 31*b* is inserted in the bottle finish 2*a* air-tightly and liquid-tightly. A supporting wall 31*d* in the shape of a horizontal plate is formed unitarily within the second cylindrical portion 31*b* at axially middle part of the portion 31*b*. The supporting wall 31*d* has four axial through-hole formed surrounding central part of the wall 31*d* as if the through-holes avoided the central part. A recess that accommodates a connector sleeve 83 and a valve head 82 of a dispensing valve 8, which will be described below, is defined on the upper side of the supporting wall 31*d*.

The second member 32 is of substantially cylindrical shape gradually reduced in diameter toward the distal end. A top plate with nozzle 3*a* is unitarily formed at the distal end of the second member 32. A screw thread 32*a* that is able to be in mesh with the screw thread 21*c* is formed on the inner surface of the second member 32. The first cylindrical portion 31*a* of the first member 31 is fitted in the second member 32 at axially middle part of the member 32. A distal portion of the second member 32 is formed as a cylindrical portion with reduced diameter through a step. A screw thread 32*b* to be screwed in a cap 40 is formed on the outer periphery of the cylindrical distal portion.

A distal face 12 of the second cylindrical portion 31*b* and flange 31*c* of the first member 31 is progressively tapered outwards, that is, toward the proximal end, whereas the second member 32 has a face 13 that is disposed vertically opposite to the face 12 and is progressively tapered outwards, that is, toward the distal end.

A thin-plate filter 7 is attached to the middle part of the inner surface (i.e., undersurface) of the top plate. Though the filter 7 in this embodiment is a membrane filter, any filter, for example, a filter of sintered compact, a hydrophilic porous membrane or a hydrophobic porous membrane, which prevents predetermined kinds of microbes such as true fungi and bacteria from entering the container from its downstream side (i.e., from outside) may be used. The filter 7 is secured on the downstream side of the dispensing valve 8. In this embodiment, filter 7 is disposed adjacent to the nozzle 3*a* and secured by a retainer 50 fitted in a cavity 9 defined within the second member 32 and above the first member 31. The retainer 50 has through-holes 50*a* through which liquid can flow toward the filter 7.

The passage through the nozzle 3*a* is formed on the downstream and distal side of the central part of the filter 7. The content of the passage through the nozzle 3*a* is not greater than 0.05 ml, which corresponds to the content of one droplet of eyedrops discharged from the tip of the nozzle.

The discharging passage 10 of the plug assembly 3 consists mainly of the through-holes 6, the cavity 9, the through-holes 50*a* and the passage through the nozzle. The downstream end portion of the passage 10 is formed by the passage through the nozzle.

Figure 5:
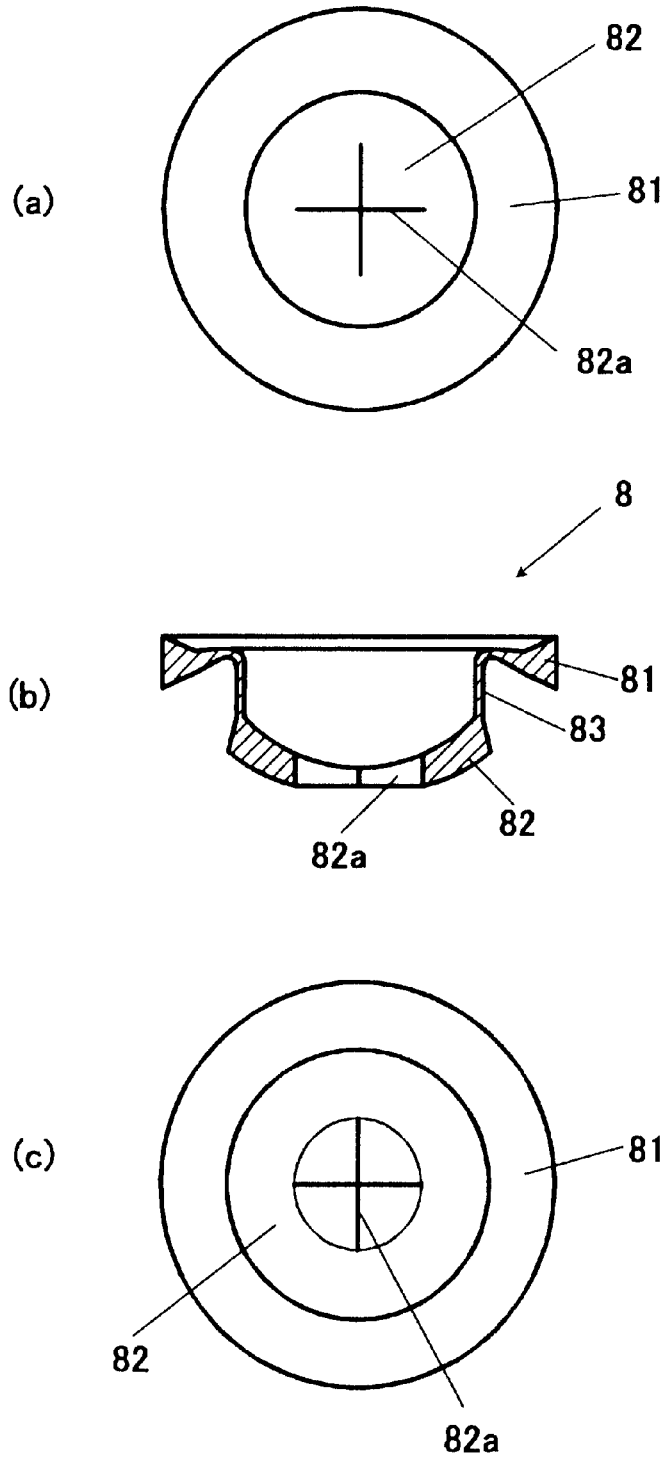
FIG. 5(*a*) is a plan view of a dispensing valve secured in the mouth of the container.

As shown in FIG. 5, the dispensing valve 8 consists of three portions, that is, a valve flange 81, a valve head 82 and a connector sleeve 83, all formed unitarily of a resilient material, such as silicone rubber.

The valve flange 81 has a substantially annular shape with wedge-shaped cross-section that becomes progressively thicker toward outward. The valve flange 81 is sandwiched axially between the first and second members 31, 32 air-tightly and liquid-tightly. More specifically, the valve flange 81 is sandwiched between a couple of the tapered faces 12, 13 arranged vertically opposite to each other, thereby sealing the periphery of the discharging passage 10 air-tightly and liquid-tightly.

The valve head 82 is circular in plan view and curves generally spherically toward the inside of the bottle 2. The central portion of the valve head 82 has an orifice 82*a* formed by crucial incision. The orifice 82*a* opens to allow flow of fluid therethrough it if pressure acted on the inner surface of the valve head 82 is more than a predetermined pressure, which will also be called as "a first predetermined pressure" or "the predetermined dispensing pressure", and closes to stop the flow of fluid if the pressure acted on the inner surface is less than the predetermined pressure. The inner surface of the central portion of the valve head 82 is flattened to form a substantially flat face, within which the orifice 82*a* is formed. The substantially flat face is usually in face contact with the upper and downstream side of the supporting wall 31*d*.

The connector sleeve 83 is substantially cylindrical and one axial end of the sleeve 83 is connected unitarily to the inner periphery of the valve flange 81, whereas the other axial end is connected unitarily to the outer periphery of the valve head 82. The connector sleeve 83 has a resilient flexible structure with a relatively thin wall to be deformed easily. Thereby, the connector sleeve 83 is deformed resiliently as if it turns inside out to shift the valve head 82 downstream with the orifice 82*a* remaining closed if pressure acted on the inner surface of the valve head 82 is more than a second predetermined pressure that is less than the first predetermined pressure (i.e., the predetermined dispensing pressure). The connector sleeve 83 returns to its original shape with the orifice 82*a* remaining closed if the pressure acted on the inner surface is less than the second predetermined pressure, thereby sucking fluid remaining within the downstream end portion of the passage back to the upstream side of the filter. The force to suck the fluid may originate from the resilient returning force of the connector sleeve 83 or from the negative pressure inside the valve head 82.

The cap 40 is screwed detachably over the outer periphery of the distal portion of the second member 32 and protects the nozzle 3*a* and the area surrounding the nozzle 3*a* from contamination by dust, microbes, or the like in ambient air. The top plate portion of the cap 40 has a projection 41 projecting downward at the central part of its undersurface which fits in and blocks the passage through the nozzle 3*a* when the cap 40 is screwed over the distal portion of the second member 32.

Figure 6:
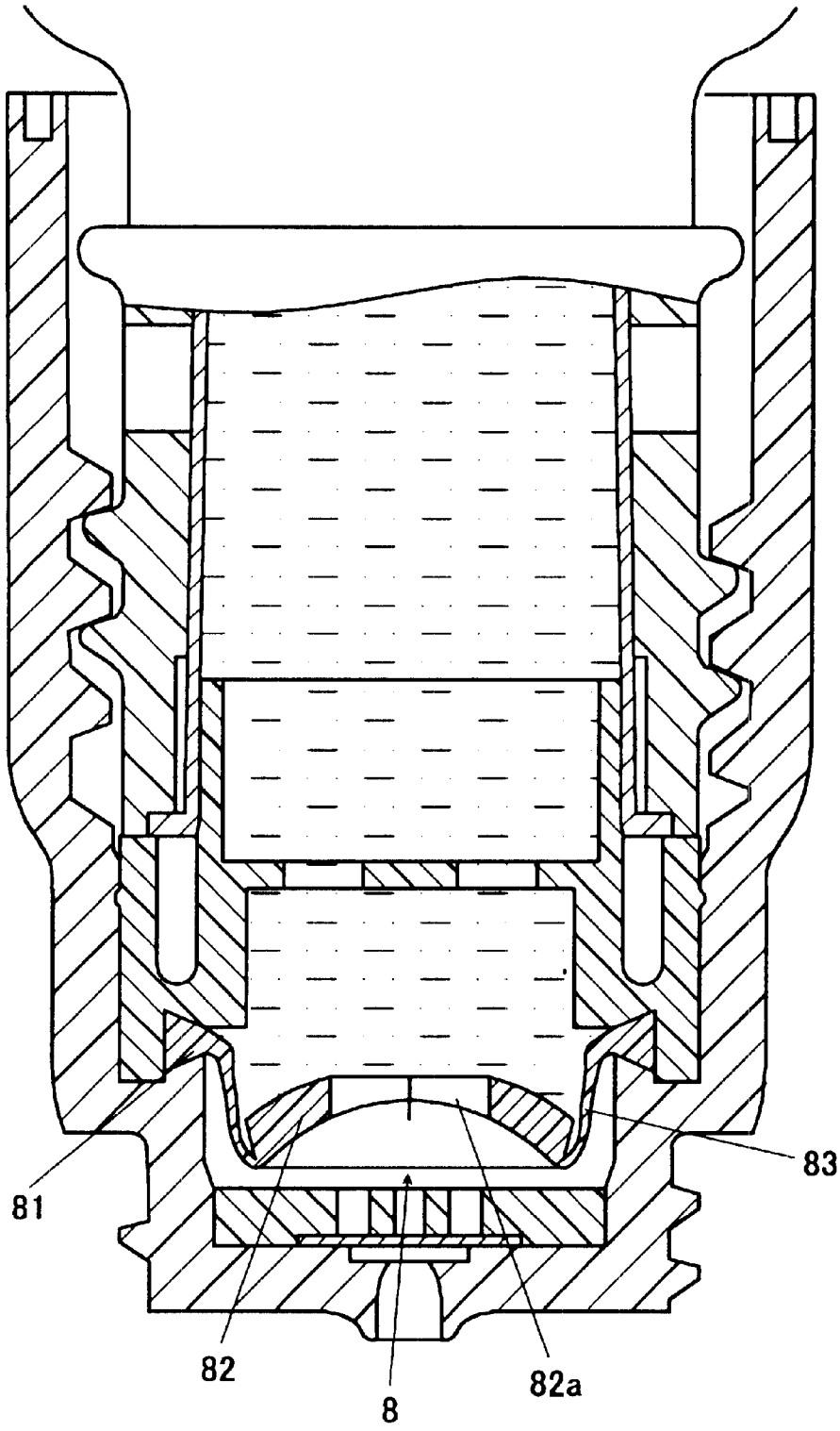
FIG. 6 is an enlarged sectional view of the part of the container as the valve head of the valve is fully shifted downstream and the orifice of the valve is closed.
Figure 7:
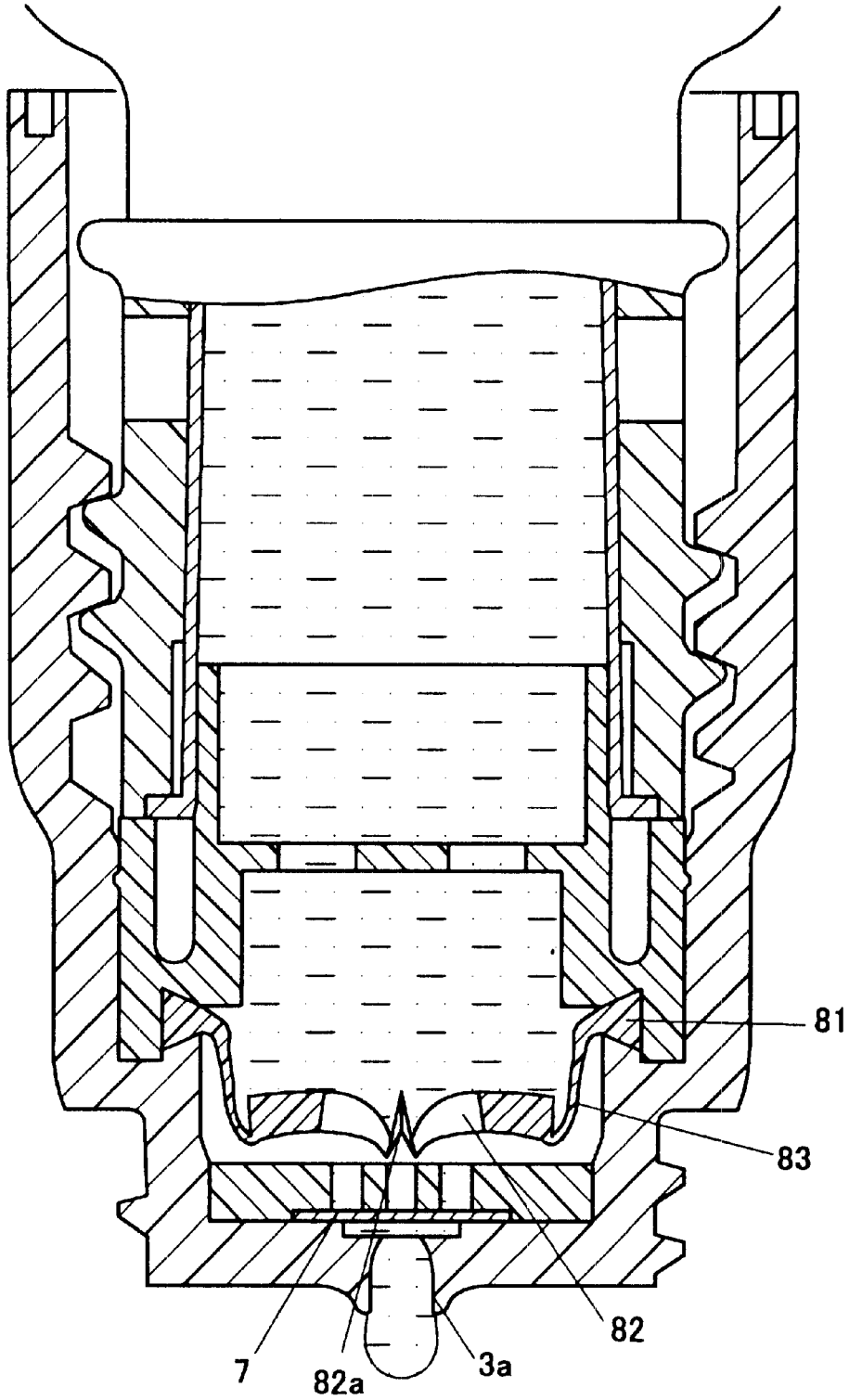
FIG. 7 is an enlarged sectional view of the part of the container as the valve head is fully shifted downstream and the orifice is opened.
Figure 8:
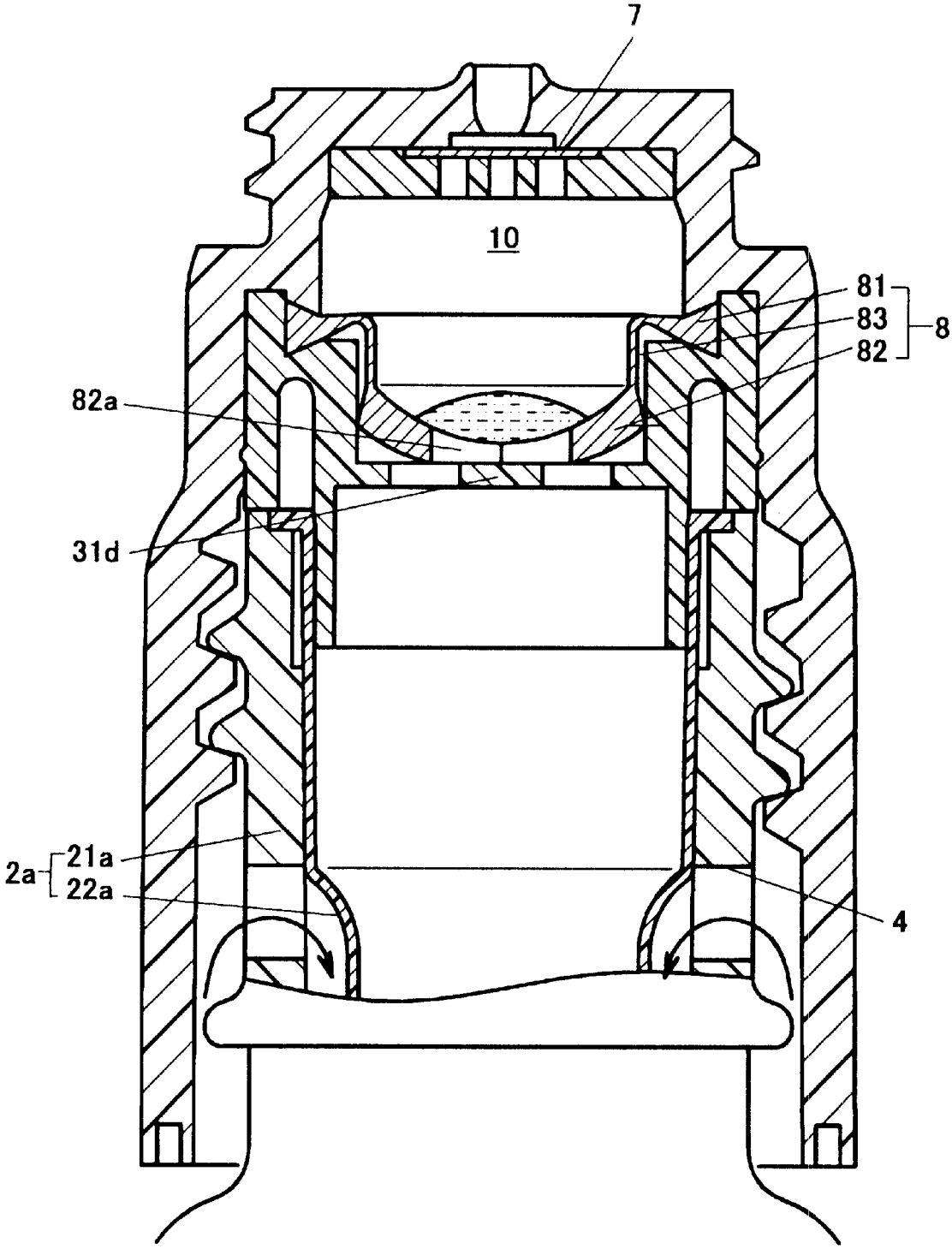
FIG. 8 is an enlarged sectional view of the part including the mouth of the container as the valve has returned its original shape after an amount of liquid is discharged.

If internal pressure of the eyedrops container 1 in this embodiment should rise in relatively small amount to a pressure less than the predetermined dispensing pressure, the valve head 82 is shifted downstream with the orifice 82*a* of the dispensing valve 8 remaining closed, as shown in FIG. 6, thereby decreasing the internal pressure and modifying the pressure rise. When a user turns the bottle 2 bottom up and press the body 2*b* along the direction of the minor axis of the oval body 2*b* to raise the pressure acted on the inner surface of the valve head 82 over the predetermined dispensing pressure, intending to dispense contained liquid through the nozzle 3*a,* the orifice 82*a* opens and the liquid contained in the inner layer 22 is discharged through the orifice 82*a* and falls dropwise from the tip of the nozzle 3*a,* as shown in FIG. 7. With the ceasing of pressing the bottle 2, at first the valve head 82 returns to its original shape to close the orifice 82*a* and then the connector sleeve 83 returns to its original shape. With the return of the sleeve 83, fluid remaining within the passage through the nozzle 3*a,* i.e., the downstream end portion of the discharging passage, is sucked back to the cavity 9 on the upstream side of the filter 7. The sucked liquid is contained in the cavity 9, being protected from the ambient air by the filter 7, as shown in FIG. 8.

With the ceasing of pressing the bottle 2, the outer layer 21 returns to its original shape, whereas the inner layer 22 does not return to its original shape, being deflated with the decrease of the liquid contained therein, since backflow of liquid and inflow of ambient air are shut off as the orifice 82*a* is closed. On the other hand, with the return of the outer layer 21 to its original shape, ambient air flows into the space between the outer and inner layers 21, 22 through the vents 4 of the outer layer 21 which open because the inner finish 22*a* is deformed radially inwards by ambient atmospheric pressure owing to the negative pressure generated in the space between the outer body 21*b* and the inner body 22*b*. Though at the same time a negative pressure is also generated in the space within the inner layer 22, thus generating force acting on the valve head 82 to deform the head 82 toward inside of the container, the opening of the orifice 82*a* resulting from inward deformation of the head 82 is prevented and inflow of ambient air into the space within the inner layer 22 is prevented in spite of the flexible structure of the head 82, because the head 82 touches and is supported by the supporting wall 31*d*. When the outer body 21*b* returns to its original shape, with sufficient amount of ambient air having flowed in through the vents 4, the inner finish 22*a* also returns to its original cylindrical shape, dissolving the deformation, owing to resilience of the inner finish 22*a* itself, to cover and seal the vents 4 again.

When the user presses the bottle 2 again, air contained in the space between the outer and inner bodies 21*b*, 22*b* is compressed owing to decrease of volume of the space caused by the deformation of the outer body 21*b*, since the air cannot escape as the inner finish 22*a* is in close contact with the outer finish 21*a* and seals the vents 4. The compressed air presses the inner body 22*b* inwards. The liquid in the cavity 9 is discharged from the nozzle 3*a* before the configuration shown in FIG. 6 is realized.

Figure 9:
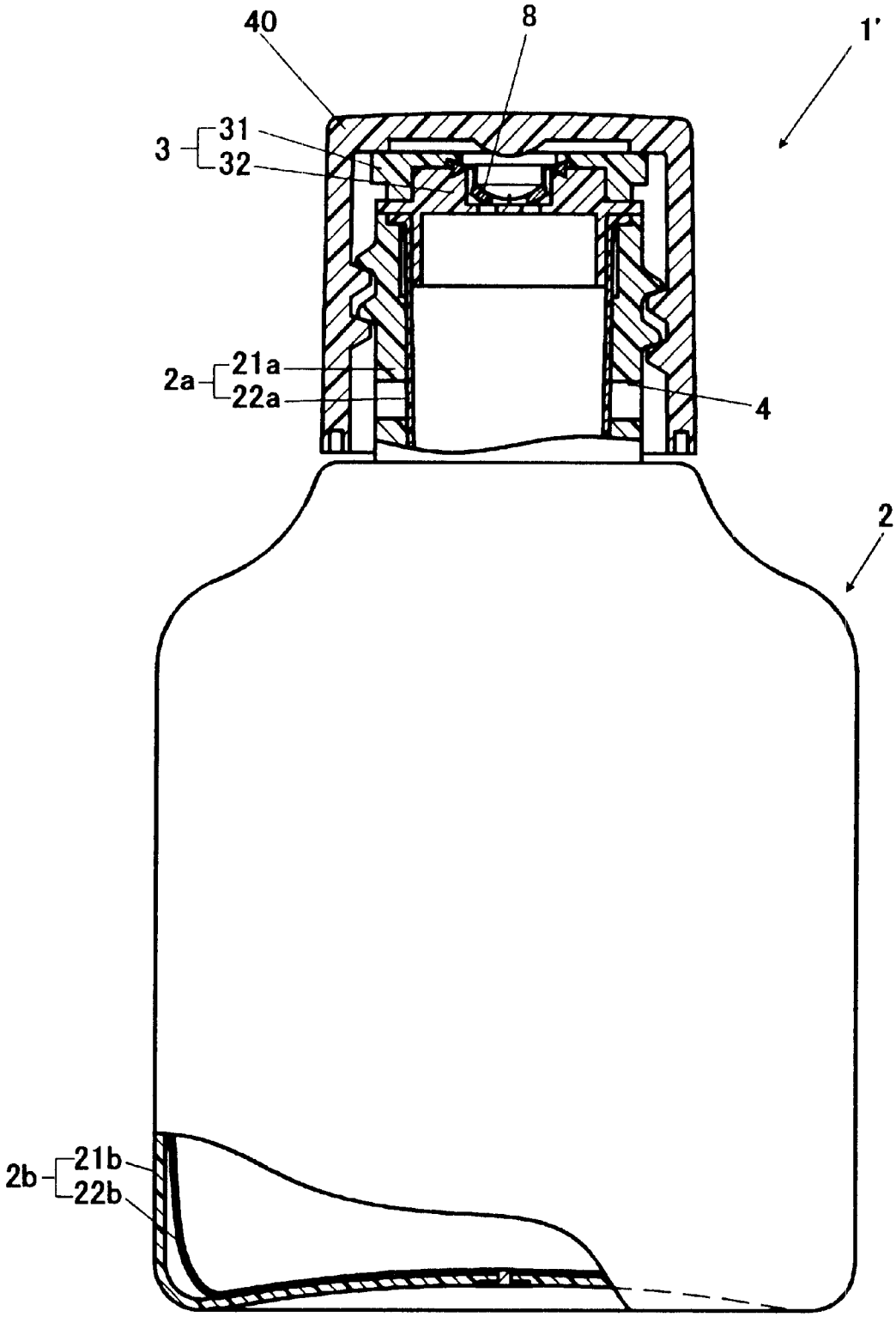
FIG. 9 is a partly sectional front view of a dispensing container provided in a second embodiment of the invention.
Figure 10:
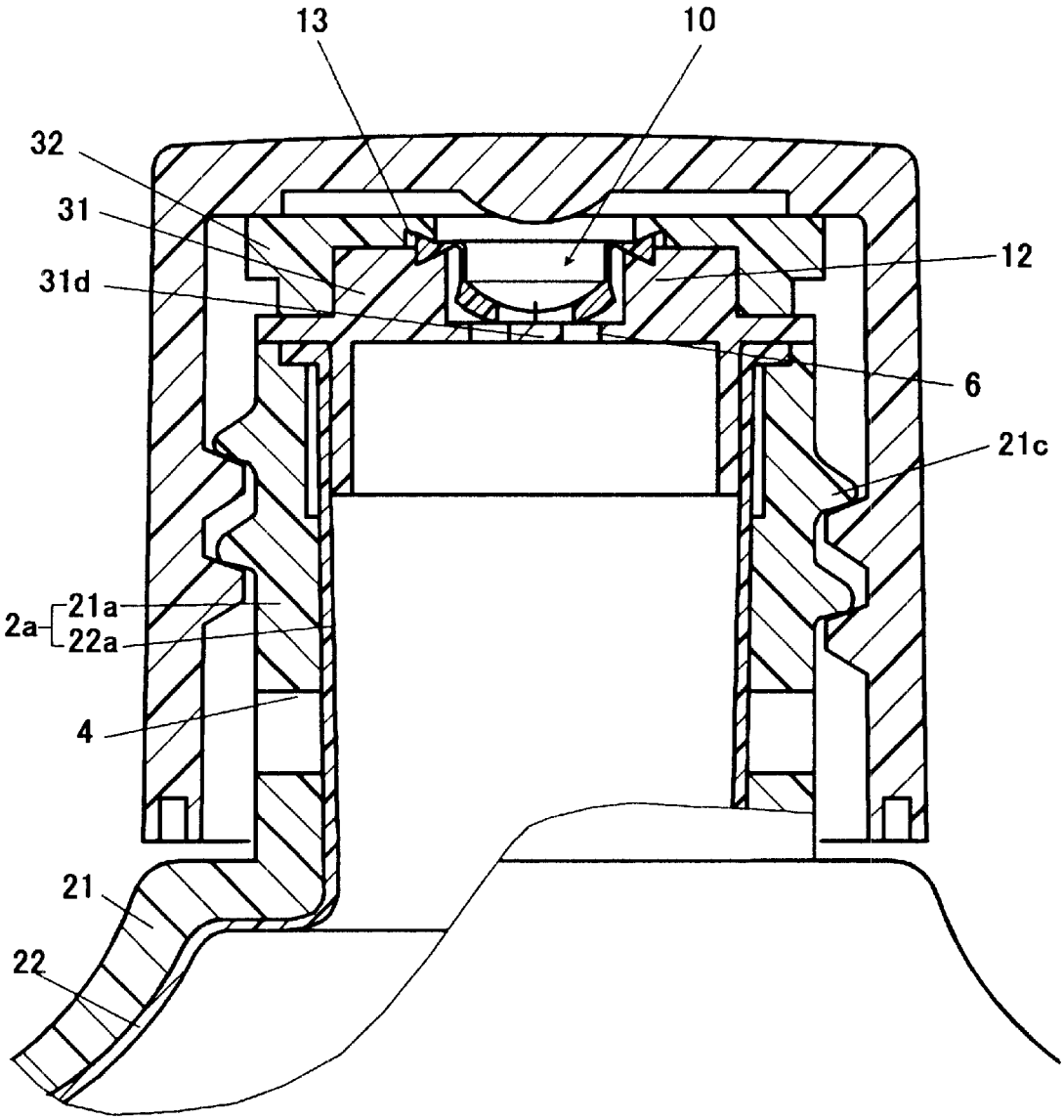
FIG. 10 is an enlarged vertical sectional view of a part of the container including the mouth shown in FIG. 9.

FIG. 9 and FIG. 10 show a container 1' for fluid for hair, such as shampoo and rinse, as a dispensing container of a second embodiment of the invention. A cap 40 of the container 1' is screwed over a bottle finish 2*a*. A plug assembly 3 has neither a filter nor a retainer of a filter so that a dispensing valve 8 is exposed to the ambient air when the cap 40 is off. A first member 31 is fitted and fixed in the second member 32 to form the plug assembly 3 together. Other members and components are not described here in detail because each of them is identical with or similar to each of those with the same numeral in the first embodiment.

It should be understood that the invention is not limited to the details of the specific structure and arrangement shown in the above-described embodiments and that various changes and modifications may be made without departing from the spirit and the scope of the invention as hereinafter claimed.

The invention prevents microbes from proliferating in the liquid, containing no preservative, within the containing portion or the discharging passage of a dispensing container in case that the dispensing container has a dispensing valve which is closed if pressure acted on the inner surface of the container is atmospheric and opens if the pressure acted on the inner surface exceeds a predetermined pressure.

What is claimed is:

1. A dispensing container comprising an outer bottle and an inner bag for containing fluid housed within the outer bottle, the outer bottle including a body and a mouth, the inner bag having a discharge opening communicating to the mouth of the outer bottle, a vent located in the outer bottle so as to introduce ambient air into space between the outer bottle and the inner bag, said dispensing container further comprising a closing member, a dispensing valve and a filter, wherein:

the closing member is mounted on the mouth of the outer bottle;

the closing member has a discharging passage through which fluid is discharged out of the container from inside of the bag;

the valve is located in the passage in order to open and close the passage;

the filter is located in the passage on the downstream side of the valve;

a downstream end portion of the passage is defined on the downstream side of the filter;

the valve comprises a valve flange, a valve head and a connector sleeve;

the valve flange seals an inner periphery of the passage;

the valve head has an orifice that opens to allow flow of fluid therethrough if a first predetermined pressure acts on the inner surface of the valve head and closes to stop the flow of fluid if the first pressure removes from the inner surface;

the connector sleeve is connected to an inner periphery of the valve flange at one end and to an outer periphery of the valve head at the other end;

the connector sleeve is deformed to shift the valve head downstream if a second predetermined pressure which is less than the first pressure acts on the inner surface of the valve head;

the connector sleeve returns to its original shape if the second pressure removes from the inner surface to suck fluid remaining within the downstream end portion of the passage back to the upstream side of the filter; and the closing member has a supporter that makes contact with and supports the valve head to prevent the orifice from opening when a negative pressure is generated in the bag.

2. The dispensing container according to claim 1;

wherein the valve head is generally convex toward the inner side of the container, the valve head has a substantially flat face at the central part of the inner and upstream surface, and the supporter has a supporting surface capable of making a face contact with the substantially flat face.

3. The dispensing container according to claim 1;

wherein the filter prevents predetermined kinds of microbes from passing therethrough from upstream side to downstream side.

4. The dispensing container according to claim 1, wherein:

the mouth has an axis;

the closing member comprises a first member fitted in the mouth and a second member axially connected to the first member;

the valve flange is sandwiched axially between the first and second members air-tightly and liquid-tightly;

the first member has the supporter in the form of a plate with an axial through-hole; and a recess which accommodates the connector sleeve and the valve head is located in the first member on the upper and downstream side of the supporter.

5. A closing structure of a dispensing container comprising a closing member, a dispensing valve and a filter, wherein:

the closing member is mounted on the mouth of a bottle including a body and a mouth;

the closing member has a discharging passage through which fluid is discharged out of the bottle;

the valve is located in the passage in order to open and close the passage;

the filter is located in the passage on the downstream side of the valve;

the valve comprises a valve flange, a valve head and a connector sleeve;

the valve flange seals an inner periphery of the passage;

the valve head has an orifice that opens to allow flow of fluid therethrough if a first predetermined pressure acts on the inner surface of the valve head and closes to stop the flow of fluid if the first pressure removes from the inner surface;

the connector sleeve is connected to an inner periphery of the valve flange at one end and to an outer periphery of the valve head at the other end;

the connector sleeve is deformed to shift the valve head downstream if a second predetermined pressure which is less than the first pressure acts on the inner surface of the valve head; and the connector sleeve returns to its original shape if the second pressure removes from the inner surface to suck fluid remaining within the downstream end portion of the passage back to the upstream side of the filter.

6. The closing structure according to claim 5;

wherein the filter prevents predetermined kinds of microbes from passing therethrough from upstream side to downstream side.

7. The closing structure according to claim 5, wherein:

the mouth has an axis;

the closing member comprises a first member fittable in the mouth and a second member axially connected to the first member;

the valve flange is sandwiched axially between the first and second members air-tightly and liquid-tightly;

the first member has a supporting wall in the form of a horizontal plate with an axial through-hole, the wall making contact with and supporting the valve head to prevent the orifice from opening when a negative pressure is generated in the bottle; and a recess which accommodates the connector sleeve and the valve head is located in the first member on the upper and downstream side of the supporting wall.

8. A dispensing container comprising an outer bottle and an inner bag for containing fluid housed within the outer bottle, the outer bottle including a body and a mouth, the inner bag having a discharge opening communicating to the mouth of the outer bottle, a vent located in the outer bottle so as to introduce ambient air into space between the outer bottle and the inner bag, said dispensing container further comprising a closing member and a dispensing valve, wherein:

the closing member is mounted on the mouth of the outer bottle;

the closing member has a discharging passage through which fluid is discharged out of the container from inside of the bag;

the valve is located in the passage in order to open and close the passage;

the valve comprises a valve flange and a valve head;

the valve flange seals an inner periphery of the passage;

the valve head has an orifice that opens to allow flow of fluid therethrough if a first predetermined pressure acts on the inner surface of the valve head and closes to stop the flow of fluid if the first pressure removes from the inner surface;

the valve head is connected to an inner periphery of the valve flange; and the closing member has a supporter that makes contact with and supports the valve head to prevent the orifice from opening when a negative pressure is generated in the bag.

9. The dispensing container according to claim 8;

wherein the valve head is generally convex toward the inner side of the container, the valve head has a substantially flat face at the central part of the inner and upstream surface, and the supporter has a supporting surface capable of making a face contact with the substantially flat face.

10. The dispensing container according to claim 8, wherein:

the mouth has an axis;

the closing member comprises a first member fitted in the mouth and a second member axially connected to the first member;

the valve flange is sandwiched axially between the first and second members air-tightly and liquid-tightly;

the first member has the supporter in the form of a plate with an axial through-hole; and a recess which accommodates the connector sleeve and the valve head is located in the first member on the upper and downstream side of the supporter.

* * * * *